US011479054B2

(12) United States Patent
Downing et al.

(10) Patent No.: US 11,479,054 B2
(45) Date of Patent: Oct. 25, 2022

(54) RESTRAINING EXTENSIONS

(71) Applicant: HEWLETT-PACKARD DEVELOPMENT COMPANY, L.P., Spring, TX (US)

(72) Inventors: Elliott Downing, Vancouver, WA (US); Bruce G. Johnson, Vancouver, WA (US); Robert Yraceburu, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,966

(22) PCT Filed: Jun. 27, 2018

(86) PCT No.: PCT/US2018/039684
§ 371 (c)(1),
(2) Date: Oct. 1, 2019

(87) PCT Pub. No.: WO2020/005219
PCT Pub. Date: Jan. 2, 2020

(65) Prior Publication Data

US 2022/0032664 A1 Feb. 3, 2022

(51) Int. Cl.

| | |
|---|---|
| ***B65H 29/46*** | (2006.01) |
| ***B41J 13/10*** | (2006.01) |
| ***B65H 29/02*** | (2006.01) |
| ***B65H 29/52*** | (2006.01) |
| ***B65H 31/02*** | (2006.01) |
| ***B65H 31/26*** | (2006.01) |
| ***B65H 31/30*** | (2006.01) |
| ***B65H 31/34*** | (2006.01) |
| ***B65H 43/04*** | (2006.01) |

(52) U.S. Cl.
CPC ..... *B41J 13/106* (2013.01); *B65H 29/02* (2013.01); *B65H 29/46* (2013.01); *B65H 29/52* (2013.01); *B65H 31/02* (2013.01); *B65H 31/26* (2013.01); *B65H 31/3063* (2013.01); *B65H 31/34* (2013.01); *B65H 43/04* (2013.01); *B65H 2301/331* (2013.01); *B65H 2301/4212* (2013.01); *B65H 2301/4213* (2013.01); *B65H 2301/4223* (2013.01); *B65H 2404/611* (2013.01); *B65H 2404/693* (2013.01); *B65H 2511/242* (2013.01); *B65H 2801/27* (2013.01)

(58) Field of Classification Search
CPC combination set(s) only.
See application file for complete search history.

(56) References Cited

U.S. PATENT DOCUMENTS 5,263,697 A 11/1993 Yamazaki et al.
6,702,278 B1 * 3/2004 Michel ..... B65H 31/26 271/207

(Continued)

FOREIGN PATENT DOCUMENTS

WO WO2017099741 A1 6/2017
WO WO2018048430 A1 3/2018

*Primary Examiner* — Jennifer Bahls
(74) *Attorney, Agent, or Firm* — Brooks Cameron & Huebsch PLLC

(57) ABSTRACT

An example system may comprise a media support including a wall and a base and a restraining extension extending in a first direction to constrain print media, when present, to a space below the restraining extension.

17 Claims, 7 Drawing Sheets

(56) References Cited

U.S. PATENT DOCUMENTS

| | | | | |
|---|---|---|---|---|
| 7,172,186 | B2 | 2/2007 | Saito et al. | |
| 7,243,913 | B2 | 7/2007 | Terao et al. | |
| 7,267,337 | B2 | 9/2007 | Moore et al. | |
| 7,530,567 | B2 | 5/2009 | Bober et al. | |
| 7,690,633 | B2 | 4/2010 | Tamura et al. | |
| 8,220,794 | B2 | 7/2012 | Terao et al. | |
| 2006/0255531 | A1 | 11/2006 | Azzopardi et al. | |
| 2012/0127226 | A1 | 5/2012 | Chen et al. | |
| 2019/0210829 | A1* | 7/2019 | Rasmussen ..... | B65H 29/10 |

* cited by examiner

RESTRAINING EXTENSIONS

BACKGROUND

Imaging systems, such as printers, may allow text, images, and/or graphics, etc. to be printed onto print media (e.g., paper, plastic, etc.). Imaging systems may include a stacking region for the collection of print media. Imaging systems may be provided with a finishing device where the print media may be collected for a finishing process, such as stapling, three-hole punching, etc. In this regard, the stacking may be within the imaging system where the print media are collected for post processing

DETAILED DESCRIPTION

Restraining extensions and systems are described herein. In some examples, a printing device may include a finishing device. In various examples, print media may be collected for a finishing process, such as stapling, three-hole punching, etc. In some examples, the finishing device may include a restraining extension to assist with the transport of collected print media.

As described herein, in some examples, print media may be collected for a finishing process (e.g., stapling, three-hole punching, etc.). In some examples, the printing substance may not be fully dried during stacking. In addition, alignment of print media in a stack may become difficult. For example, a print medium may be partially dried print medium. The partially dried print media may be distorted from a curl forming on the edge of print media. Due to the moisture content, the partially dried print media may have reduced stiffness which leads to buckling. In addition, after the print media is dried the fibers in the print media may not return to their original shape causing the print media to remain distorted and curled. Moreover, high print substance density regions may result in increased friction with adjacent sheets of print media. The friction may result in misalignment with other sheets of print media in the stack. Additionally, curling of the edges of print media may result in trapped air between the print media. The trapped air may result in a variety of issues, such as an artificial increase in stack height of print media. That is, the edges of print media may curl during the transport of print media to the finishing region and cause improper processing of print media in the finishing region. As used herein, "print media" refers to a plurality of papers, photopolymers, plastics, composites, metals, woods, or other material on which markings may be formed. As used herein, "print medium" refers to an individual paper, photopolymer, plastic, composite, metal, wood, or other material on which markings may be formed.

Accordingly, this disclosure describes restraining extensions and systems that constrain print media in the stacking region to a space below the restraining extension. In some examples, constraining the print media may prevent the edge of print media from curling above the restraining extension during the transport of print media to the finishing region. In addition, the restraining extension may reduce and/or eliminate improper processing of print media in the finishing region by ensuring that the edge of the print media remains in a space below the restraining extension.

Figure 1:
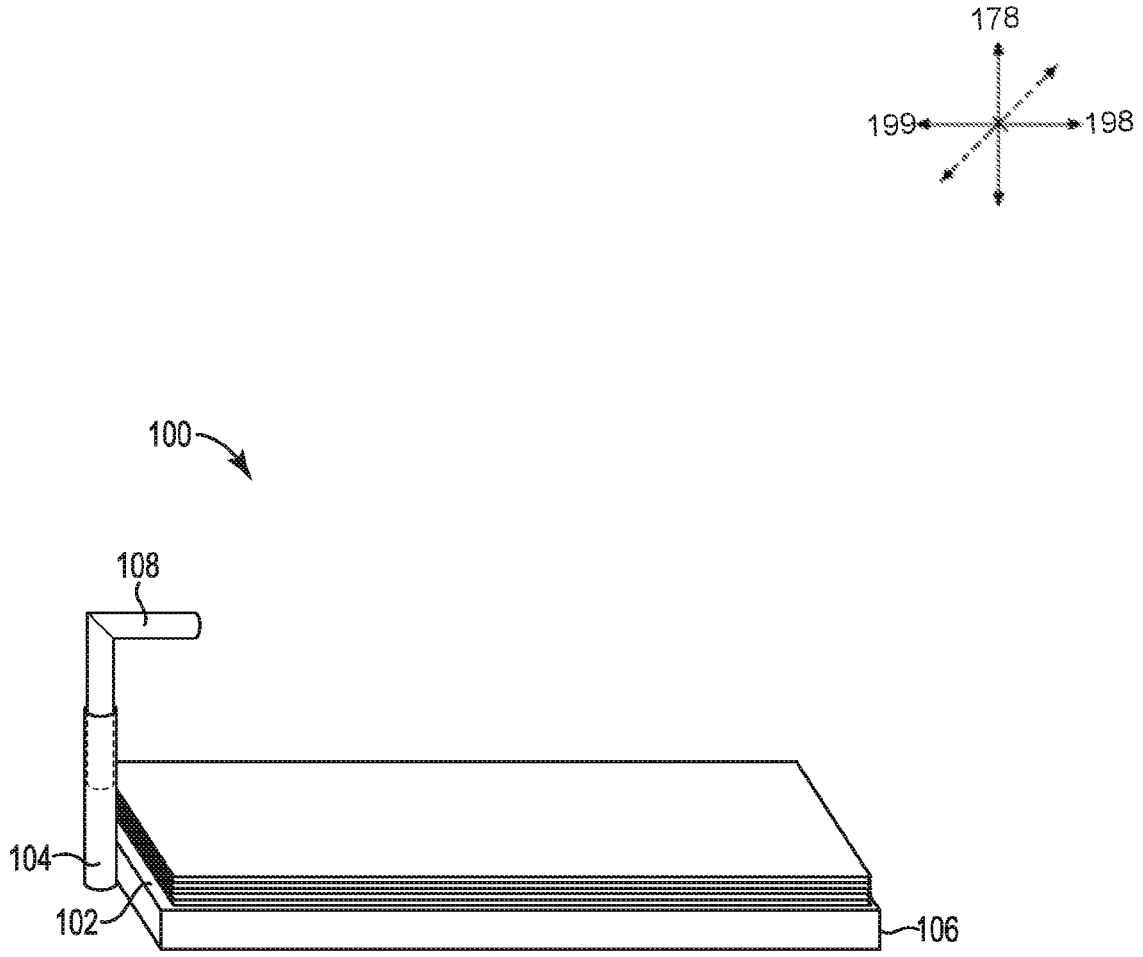
FIG. 1 illustrates an example system including a restraining extension.

FIG. 1 illustrates an example system 100 including a restraining extension 108. The system 100 may be implemented in a variety of imaging systems, such as printers, copiers, etc., for example. In some examples, the system 100 may include a media support 102. In some examples, the media support 102 may hold and/or support print media resulting from a print job. As used herein, "print job" refers to signals or states, which may be stored in a file and/or a set of files, usable to instruct a print device in forming text, images, and/or objects on print media. That is, print media may accumulate on the media support 102 during post processing of print media. In some examples, the media support 102 may transport print media in a direction as denoted by arrows 198 and 199. The media support 102 may transport print media towards a finishing region and away from a finishing region, such as a stapling region.

In some examples, the media support 102 may transport print media into a finishing region. For example, the media support 102 may transport print media from the stacking region to a stapling region for post processing of print media. In addition, the media support 102 may transport the print media away from a finishing region. For example, the media support 102 may transport print media from a stapling region to an output region. As used herein, "stacking region" refers to an area within the printing device where print media are collected for post processing.

In some examples, the stacking region may be positioned on the base 106 of the media support 102. That is, a portion of the base 106 may be used to support print media. For example, the stacking region may be positioned on a base 106 and may take up part of the base 106 leaving another part of the base 106 unoccupied. In some examples, the media support 102 may include a wall 104 connected to the base 106 of the media support 102. In some examples, the wall extends from the base 106 upwards into a direction as denoted by the arrow 178. It should be understood that when an element is referred to as being "on," "connected to", or "coupled to" another element, it may be directly on, connected, or coupled with the other element or intervening elements may be present.

In some examples, the wall 104 of the media support 102 may assist in the transportation of print media. In some examples, the wall 104 may be positioned adjacent to the stacking region. In addition, the wall 104 may transition away from the stacking region so that it is not adjacent to the stacking region during the stacking of print media. It should be understood that when an element is referred to as being "adjacent" to another element, it may be on, in contact, connected, next to, or coupled with the other element.

In some examples, the wall 104 may be coupled to a restraining extension 108, The restraining extension 108 may extend in a direction towards the print media as denoted by the arrow 198. That is, the restraining extension 108 may extend in a first direction that is substantially parallel with the base 106. In some examples, the media support 102 may include additional walls, similar to wall 104, also comprising respective restraining extensions, similar to restraining extension 108.

As used herein, the term substantially intends that the characteristic does not have to be absolute, but is close enough so as to achieve the characteristic. For example, "substantially perpendicular" is not limited to absolute perpendicular. For example, "substantially parallel" is not limited to absolutely parallel. For example, "substantially uniform" is not limited to an absolutely uniform.

In some examples, the restraining extension 108 may constrain print media to an area below the restraining extension 108. That is, as the media support 102 transports the print media into a finishing region the restraining extension 108 will prevent the edge of the print media from lifting above the restraining extension 108. As used herein, "finishing region" refers to an area of a printing device and/or finishing device where post processing of print media (e.g., stapling, three-hole punching, etc.) is carried out.

Figure 2:
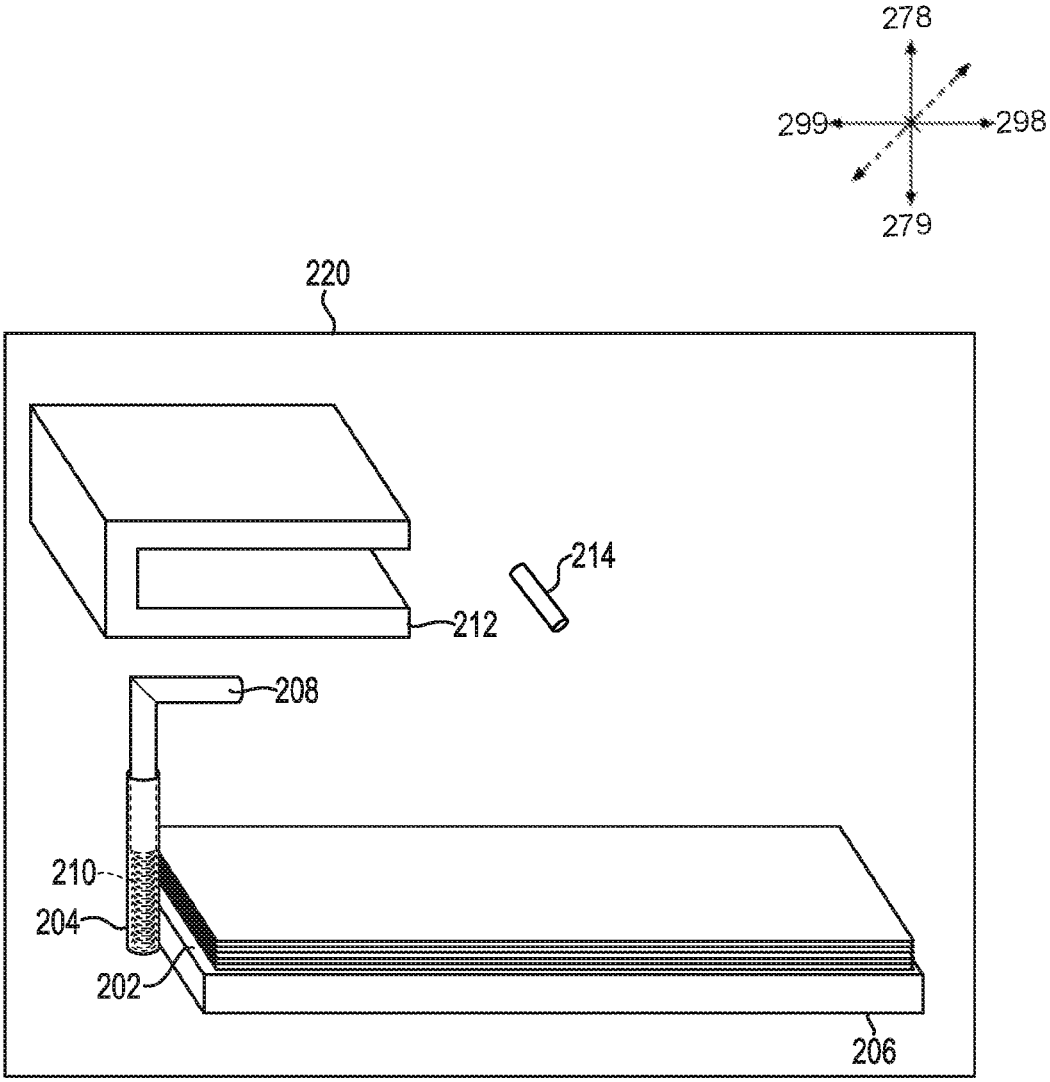
FIG. 2 illustrates an example printing device including a restraining extension.

FIG. 2 illustrates an example printing device 220 including a restraining extension 208, a media support 202, a wall 204, and a base 206, which may be similar or analogous to restraining extension 108, media support 102, wall 104, and base 106, respectively, which are discussed above in relation to FIG. 1.

In some examples, the printing device 220 may be connected to a finishing device. In some examples, the finishing device may be an external finishing device removably connected to the printing device 220. However, this description is not so limited. In some examples, the finishing device may be permanently connected to the printing device 220. As such, printing device 220 may include a media support 202 to transport print media. In some examples, the print media may be stacked in a stacking region on the base 206 of the media support 202 to transport print media.

In some examples, the printing device 220 may include a restraining extension 208 coupled to the wall 204. The restraining extension 208 may stop the edge of the print media from curling above the restraining extension 208. For example, the restraining extension 208 may constrain the print media to a particular height.

In some examples, the wall 204 may include a lifting mechanism 210 to raise and lower the restraining extension 208. In one example, lifting mechanism 210 may comprise a biasing element, such as a spring, arranged with relation to wall 204. As such, the lifting mechanism 210 may lift and lower the restraining extension 208 in a direction as denoted by the arrows 278 and 279. In some examples, as print media is stacked in the stacking region the lifting mechanism 210 may lift the restraining extension 208 to allow for stacking of print media in the stacking region of the media support. As used herein, "a stack" or "stacked" refers to a pile of print media arranged in an area and/or an individual print medium arranged in an area. In some examples, after the stacking of print media is complete the restraining extension 208 may move towards the print media in a direction as denoted by arrow 279. For instance, the restraining extension 208 may move closer to the print media to constrain the print media below the restraining extension 208.

In some examples, the lifting mechanism 210 may be a spring to lift the restraining extension 208. For instance, the lifting mechanism 210 may be a spring to push the restraining extension 208 in a given direction such as in a direction to contact the media guide 212. However, this description is not so limited. The lifting mechanism 210 may be a wedge, elastomer, urging mechanism, etc. As used herein, "lifting mechanism" refers to a device to assist in the transition of the restraining extension 208 between a second position to a first position either directly or indirectly.

In some examples, the printing device 220 may include a clamping mechanism 214. In some examples, the clamping mechanism 214 may transition print media from a media guide 212 on to the media support 202. That is, the clamping mechanism 214 may retrieve print media from the media guide 212 and place it on the media support 202 during the post processing of print media.

In some examples, the media guide 212 may be positioned adjacent to the media support 202. The media guide 212 may assist in transporting print media into the stacking region of the media support 202. In some examples, the media guide 212 may transition towards the stacking region to assist in the transport of print media onto the stacking region. That is, the media guide 212 may move closer to the stacking region in a direction as denoted by the arrow 298.

For example, the media guide 212 may move towards the stacking region in the direction denoted by arrow 298 to deliver print media to the stacking region. In some examples, the media guide 212 may transition towards the retraining extension 208 when delivering print media to a stacking region. That is, after the media guide 212 transitions towards the stacking region, the media guide 212 then transitions in towards the restraining extension 208. In some examples, as the media guide 212 transitions, in a direction denoted by arrow 279, towards the restraining extension 208 the media guide 212 may cause the lifting mechanism 210 to lower (e.g., compress in the context in which lifting mechanism 210 comprises a bias element) by exerting force onto the restraining extension 208.

In some examples, the media guide 212 may transition away from the stacking region after print media has been delivered to the stacking region. For instance, the media guide 212 may transition in a direction as denoted by 299. Similarly, after the print media is delivered to the stacking region the media guide 212 may transition, in a direction denoted by arrow 278, away from the restraining extension 208. In some examples, as the media guide 212 transitions away from the restraining extension 208 the media guide 212 may cause the lifting mechanism 210 to lift by releasing the force exerted on the restraining extension 208.

Figure 3:
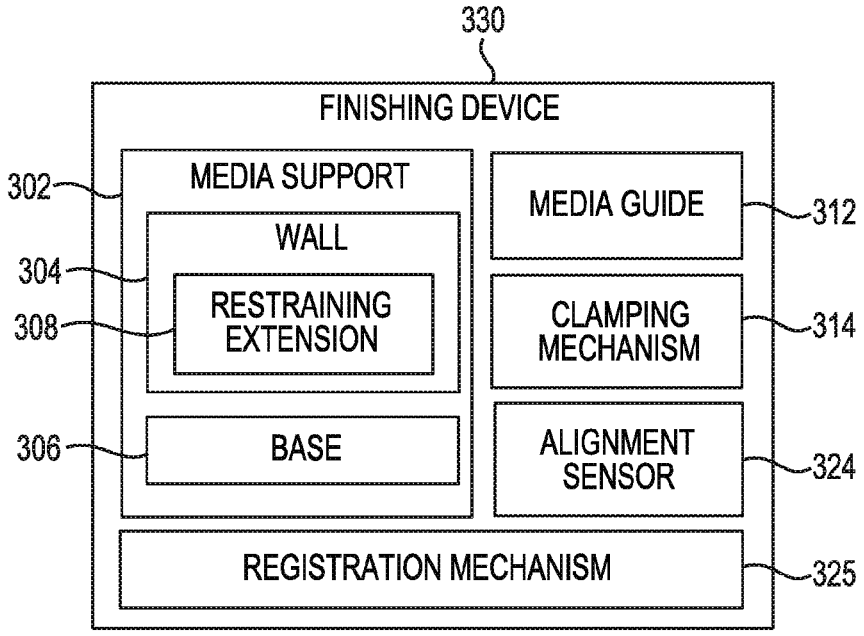
FIG. 3 illustrates an example finishing device including a restraining extension.

In some examples, as the print media is stacked in the stacking region the edges of the print media may curl. That is, the print media may be distorted from curl forming on the edge of the print media. In some examples, it may be difficult to transport distorted print media to a finishing region and/or stapling region. In addition, it may be difficult to staple the print media in a stapling region if the edge of the print media is curled. Therefore, there may be a desire for devices, components, and functionalities to enable transport of print media. One such example device, as shown in FIG. 3, example finishing device 330 includes a restraining extension 308, a media support 302, a wall 304, a base 306, a media guide 312, and a clamping mechanism 314 which may be similar or analogous to restraining extension 108 and 208, media support 102 and 202, wall 104 and 204, base 106 and 206, media guide 112 and 212, and clamping mechanism 214, respectively, as discussed above. As shall be discussed, it also includes an alignment sensor 324 and a registration mechanism 325, such as to assist in media transport.

In some examples, the wall 304 may be positioned a distance (e.g., distance 528-C of FIG. 5C) away from the stacking region. It may be desirable to move a stack of media closer to the wall 304, such as after the stacking of print media is complete. Thus, for example, the distance (e.g., distance 528-D of FIG. 5D) between the wall 304 and the stacking region may reduce after the stacking of print media is complete. The wall 304 may transition towards the stacking region before the media support 302 transports the print media to the finishing region.

As discussed above, in some examples, the restraining extension 308 may move towards the stacking region and stop the edge of the print media from curling above a designated area. Restraining print media edge curl below a designated area may be achieved by placing restraining extension 308 at a designated height during the transport of the print media.

In some examples, the finishing device 330 may include a clamping mechanism 314 to facilitate delivery of print media onto a stacking region which may collect a stack of print media. In some examples, the clamping mechanism 314 may retrieve print media from the media guide 312 and place it onto a stacking region during the post processing of print media.

In some examples, the finishing device 330 may include an alignment sensor 324 to inform a processing resource (e.g., processing resource 662 of FIG. 6) if the edge of the print media is aligned. That is, the alignment sensor 324 may send a signal to a processing resource when the edge of the print media is aligned. In addition, the alignment sensor 324 may send a signal to a processing resource when the edge of the print media is not aligned. In some examples, the alignment sensor 324 may ensure that the edge of the print media is aligned before the media support 302 transports the print media to the finishing region.

In some examples, if the edge of the print media is not aligned the registration mechanism 325 may align the edge of the print media before the media support 302 transports the print media to a finishing region. That is, the processing resource may cause the registration mechanism 325 to align the print media when the edge of the print media is not aligned. In some examples, the registration mechanism 325 may facilitate alignment of the incoming print medium with other print medium that may be in the stacking region. For example, the registration mechanism 325 may include various features which function to reduce, minimize, or eliminate misalignment of print media. In some examples, the registration mechanism 325 may be actuated once the incoming print medium is delivered to the stacking region. In some examples, the registration mechanism 325 is actuated once the stacking of print media in the stacking region is complete.

Figure 4:
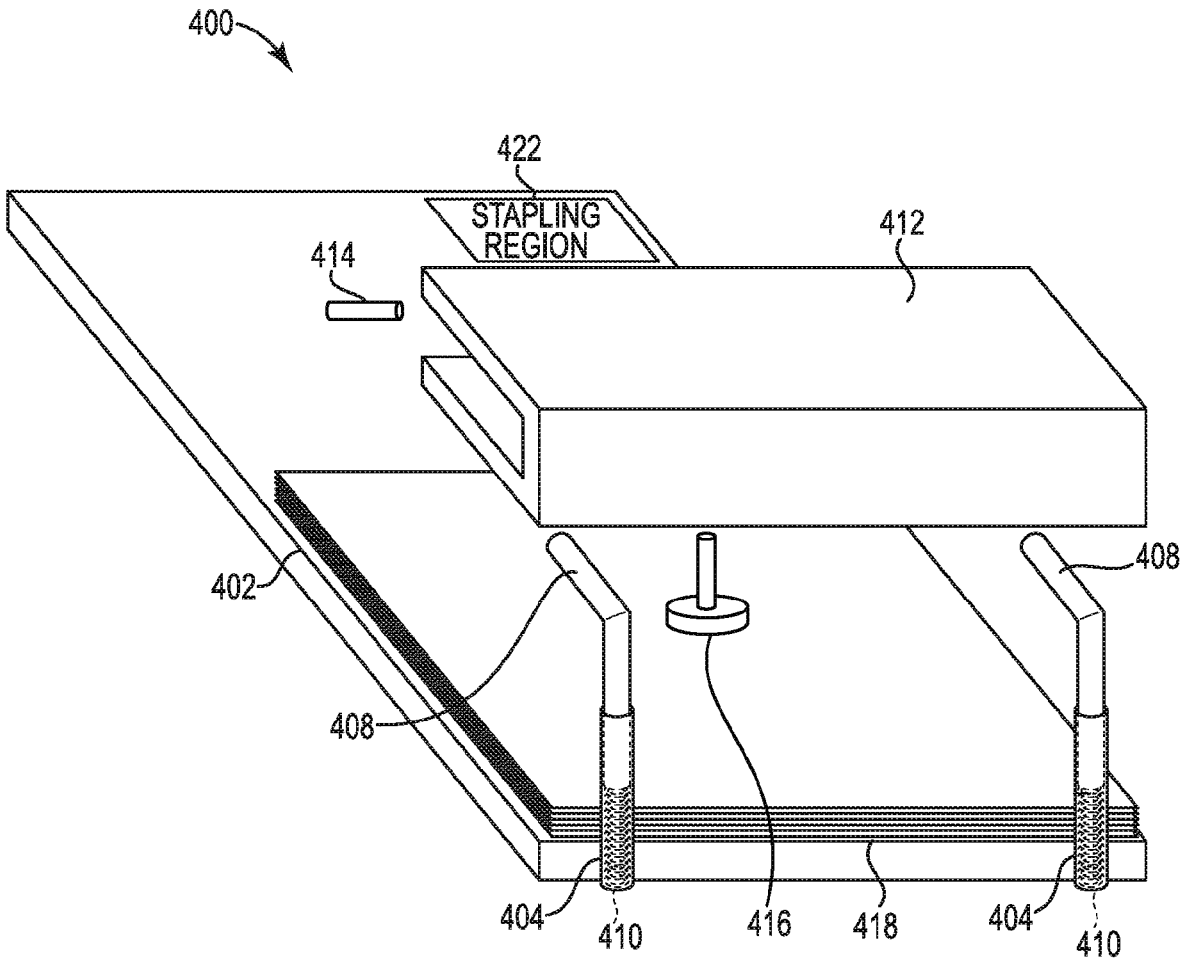
FIG. 4 illustrates an example system including a restraining extension.

FIG. 4 illustrates an example system 400 including a restraining extension 408. Lifting mechanism 410 may be analogous or similar to lifting mechanism 210 of FIG. 2 and system 400 may be analogous or similar to system 100 of FIG. 1.

In some examples, the system 400 may include a printing device and a finishing device. In some examples, the system 400 may include a media support 402 to transport print media into a stapling region 422. For example, the media support 402 may transport a stack of print media to the stapling region 422 to be stapled during a finishing process.

In some examples, the media support 402 may include a plurality of walls connected to the media support 402. In some examples, each wall 404 of the plurality of walls may include a restraining extension 408 to constrain print media to a space below the restraining extension 408. In some examples, a wall 404 of the plurality of walls may include a lifting mechanism 410 to transition the restraining extension 408 between a second position to a first position. However, this description is not so limited. In some examples, each wall 404 of the plurality of walls may include a lifting mechanism 410, among other possibilities.

In some examples, the system 400 may include a media guide 412 positioned adjacent to the media support 402. In some examples, the media guide 412 may transition towards the stacking region 418 and align print media in the media guide 412 with the stacking region 418. In some examples, the clamping mechanism 414 may transport print media from the media guide 412 to the stacking region 418. That is, the clamping mechanism 414 may stack print media in the stacking region 418 of the media support 402 to allow for transport of the print media. For example, the clamping mechanism 414 may retrieve print media from the media guide 412 and place it on the media support 402 during the post processing of print media.

In some examples, the system 400 may include a compressing mechanism 416 to compress print media to a space below the restraining extension 408. In some examples, after the restraining extension 408 is positioned directly above the stacked print media the compressing mechanism 416 may release the print media. That is, the compressing mechanism 416 may compress the print media until the restraining extension 408 is in position to constrain the print media.

Figure 5A:
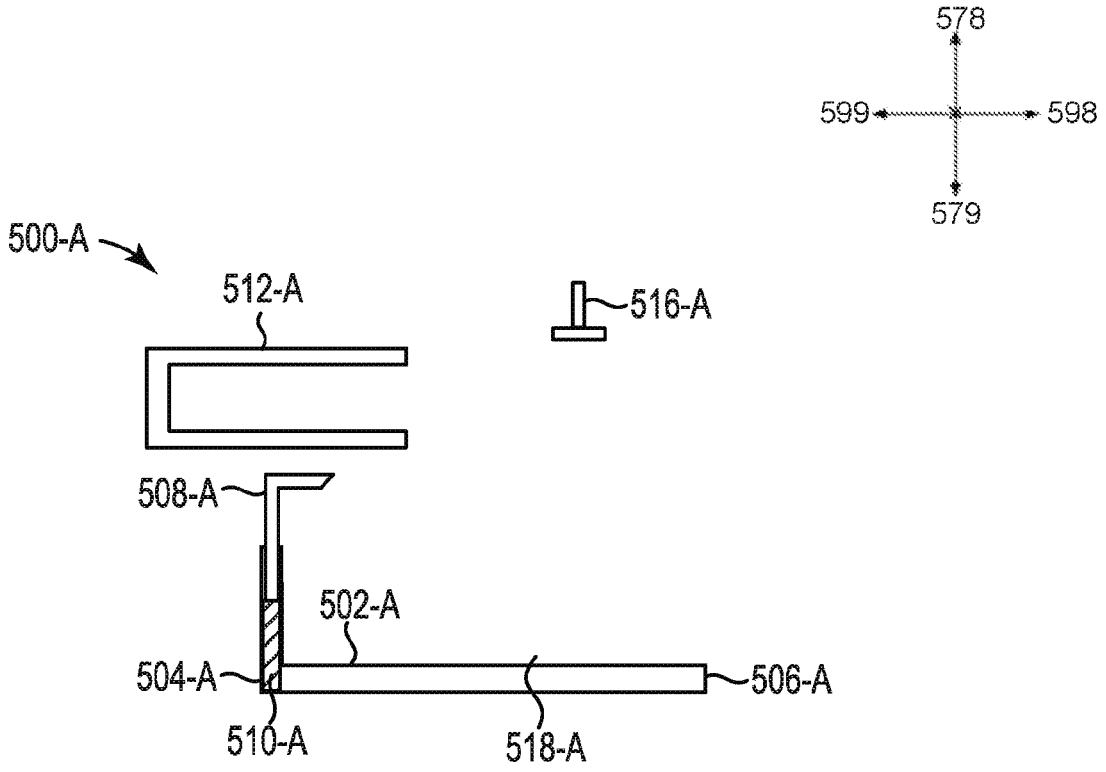
FIG. 5A illustrates an example system including a restraining extension.
Figure 5B:
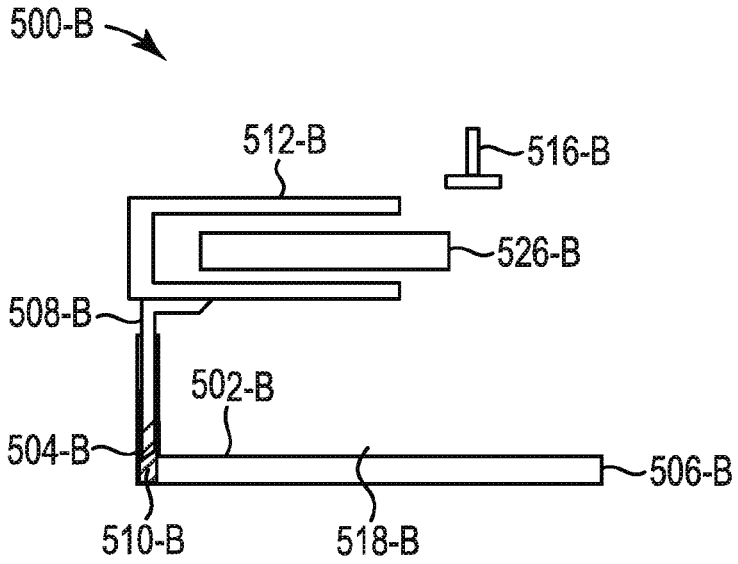
FIG. 5B illustrates an example system including a restraining extension.
Figure 5C:
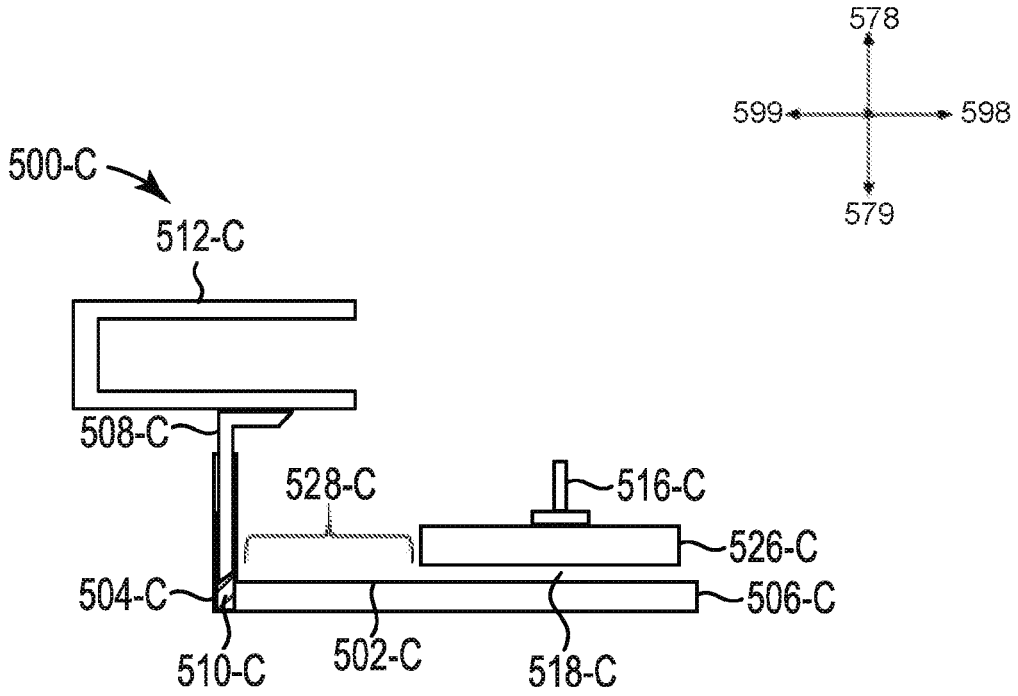
FIG. 5C illustrates an example system including a restraining extension.
Figure 5D:
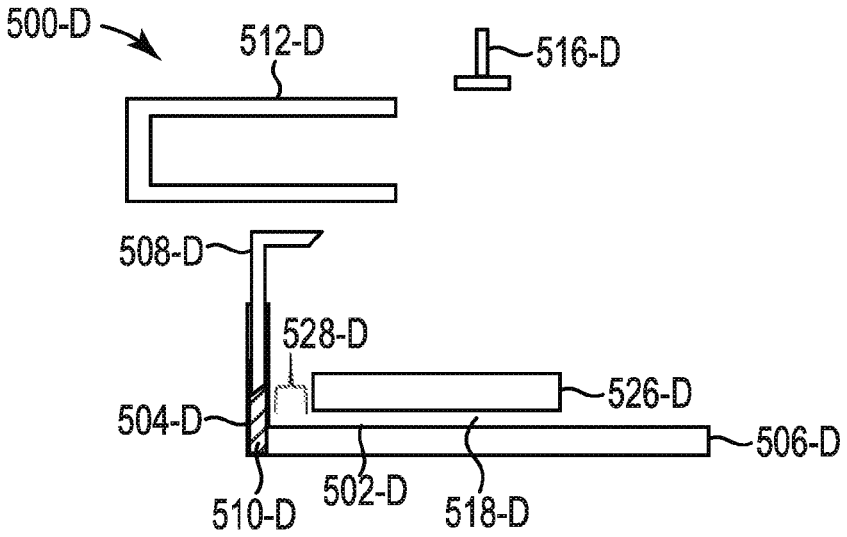
FIG. 5D illustrates an example system including a restraining extension.

In some examples, when preparing print media for post processing the system may transition between different stages while stacking print media and transporting print media to a finishing region. In addition, the system may repeat certain stages until the stacking process is complete. FIGS. 5A-5D illustrate an example of the post processing of print media. For example, FIG. 5A illustrates the system before print media is introduced to the system, FIG. 5B illustrates the system after print media enters the system, FIG. 5C illustrates the system after the delivery of print media to the stacking region, and FIG. 5D illustrates the system before transport of print media to the finishing region. It is noted that while four stages of the post processing of print media are illustrated, a post processing of print media may include more or less stages.

FIG. 5A illustrates an example system 500-A including a restraining extension 508-A. Compressing mechanism 516-A-516-D may be analogous or similar to compressing mechanism 416 of FIG. 4 and stacking region 518-A-518-D may be analogous or similar to stacking region 418 of FIG. 4.

In some examples, the system 500-A includes a media support 502-A including a wall 504-A. The media support may include a stacking region 518-A positioned on the base 506-A of the media support 502-A. In some examples, print media may be stacked in the stacking region 518-A of the media support 502-A before the print media is transported to a finishing region. In some examples, the wall 504-A may include a lifting mechanism 510-A to transition a restraining extension 508-A from a second position to a first position, System 500-A of FIG. 5A illustrates a restraining extension 508-A in a first position. That is, the restraining extension 508-A is not compressed into the wall 504-A. In some examples, the restraining extension 508-A may constrain print media to a space below the restraining extension 508-A. In some examples, the system 500-A may include a media guide 512-A to guide print media to the stacking region 518-A. In addition, the system 500-A may include a compressing mechanism 516-A to compress print media onto a stacking region 518-A.

FIG. 5B illustrates an example system 500-B including a restraining extension 508-B. In some examples, the system 500-B includes a media support 502-B including a wall 504-B. In some examples, the media support 502-B may include a stacking region 518-B positioned on the base 506-B of the media support 502-B. In addition, the system 500-B may include a lifting mechanism 510-B to transition a restraining extension 508-B between a second position to a first position. System 500-B of FIG. 5B illustrates a restraining extension 508-B in a second position. That is, the restraining extension 508-B is compressed into the wall 504-B. In some examples, the system 500-B may include a compressing mechanism 516-B.

In addition, the system 500-B may include a media guide 512-B to receive print media 526-B and guide the print media 526-B to the stacking region 518-B. In some examples, the media guide 512-B may transition towards the stacking region 518-B to guide the print media 526-B to the stacking region 518-B. For instance, the media guide 512-B may move in a direction denoted by arrow 598 before print media 526-B is delivered to the stacking region 518-B. In some examples, the media guide 512-B may transition towards the stacking region 518-B to align the print media 526-B in the media guide 512-B with the stacking region 518-B. In addition, the media guide 512-B may transition towards the restraining extension 508-B to compress the restraining extension 508-B before the print media 526-B is delivered to the stacking region 518-B. For instance, the media guide 512-B may move in a direction denoted by arrow 579 to exert a force on the restraining extension 508-B causing the restraining extension 508-B to transition from a first position to a second position.

FIG. 5C illustrates an example system 500-C including a restraining extension 508-C. In some examples, the system 500-C includes a media support 502-C including a base 506-C with a stacking region 518-C. In some examples, the media support 502-C may include a wall 504-C. The wall 504-C of the media support 502-C may include a lifting mechanism 510-C to transition a restraining extension 508-C between a second position and a first position. System 500-C of FIG. 5C illustrates a restraining extension 508-C in a second position. The restraining extension 508-C may be positioned a distance 528-C away from the print media 526-C before the print media 526-C is transported to finishing region. In some examples, the restraining extension 508-C is compressed into the wall 504-C by the media guide 512-C before transport of print media 526-C to the finishing region.

In some examples, the media guide 512-C may transition towards the restraining extension 508-C to compress the restraining extension 508-C as it guides the print media 526-C to the stacking region 518-C. That is, the media guide 512-C may exert a force on the restraining extension 508-C to transition the restraining extension 508-C between a first position and a second position. In some examples, print media 526-C may move from the media guide 512-C to the stacking region 518-C when the media guide 512-C is compressing the restraining extension 508-C. In some examples, the media guide 512-C may move in a direction denoted by arrow 599 after print media 526-C is delivered to the stacking region 518-C. That is, the media guide 512-C may transition away from the stacking region 518-C after print media is delivered to the sacking region 518-C.

In some examples, the system 500-C may include a compressing mechanism 516-C. In some examples, the clamp 516-C may compress the print media 526-C to a space below the restraining extension 508-C when the print media 526-C is delivered to the stacking region 518-C. That is, the compressing mechanism 516-C may compress print media 526-C to a space below the restraining extension 508-C after each sheet of print medium 526-C is delivered to the stacking region 518-C. However, this description is not so limited. In some examples, the compressing mechanism 516-C may compress print media 526-C to a space below the restraining extension 508-C after all sheets of print media 526-C are delivered to the stacking region 518-C.

FIG. 5D illustrates an example system 500-D including a restraining extension 508-D. In some examples, the system 500-D includes a media support 502-D including a base 506-D with a stacking region 518-D. In some examples, the media support 502-D may include a wall 504-D. The wall 504-D of the media support 502-D may include a lifting mechanism 510-D to transition a restraining extension 508-D from a second position to a first position. System 500-D of FIG. 5D illustrates a restraining extension 508-D in a first position.

In some examples, the system 500-D may include a compressing mechanism 516-D to compress print media 526-D. In some examples, the compressing mechanism 516-D may release the print media 526-D when the restraining extension 508-D is adjacent to the print media 526-D. That is, after the restraining extension 508-D is adjacent to the print media 526-D the compressing mechanism 516-D may release and the print media 526-D may remain below the restraining extension 508-D. The restraining extension 508-D may transition towards the print media 526-D and become adjacent to the print media 526-D after all print media from the resulting print job is delivered to the stacking region 518-D. That is, after all the print media 526-D is delivered to the stacking region 518-D the restraining extension 508-D may move towards the stacking region 518-D to constrain the print media 526-D to a space below the restraining extension 508-D. For instance, the distance 528-D between the stacking region 518-D and the restraining extension 508-D may reduce (e.g., smaller than distance 528-C of Figure C) when the restraining extension 508-D is adjacent to the print media 526-D.

In some examples, the media guide 512-D may assist the lifting mechanism 510-D in transitioning the restraining extension 508-D between a second position and a first position. For example, the media guide 512-D may transition away from the restraining extension 508-D to allow the restraining extension 508-D to transition to the first position. That is, the media guide 512-D may release the force exerted on the restraining extension 508-D allowing the lifting mechanism 510-D to transition the restraining extension 508-D from a second position to a first position. For instance, the media guide 512-D may move in the in a direction as denoted by the arrow 578 to release the restraining extension 508-D and allow the restraining extension 508-D to transition from a second position to a first position. In some examples, after all print media 526-D has been delivered to the stacking region 518-D and the restraining extension 508-D is adjacent to the print media 526-D the media guide 512-D may move in a direction as denoted by the arrow 578. That is, the media guide 512-D may transition away from the stacking region 518-D.

Figure 6:
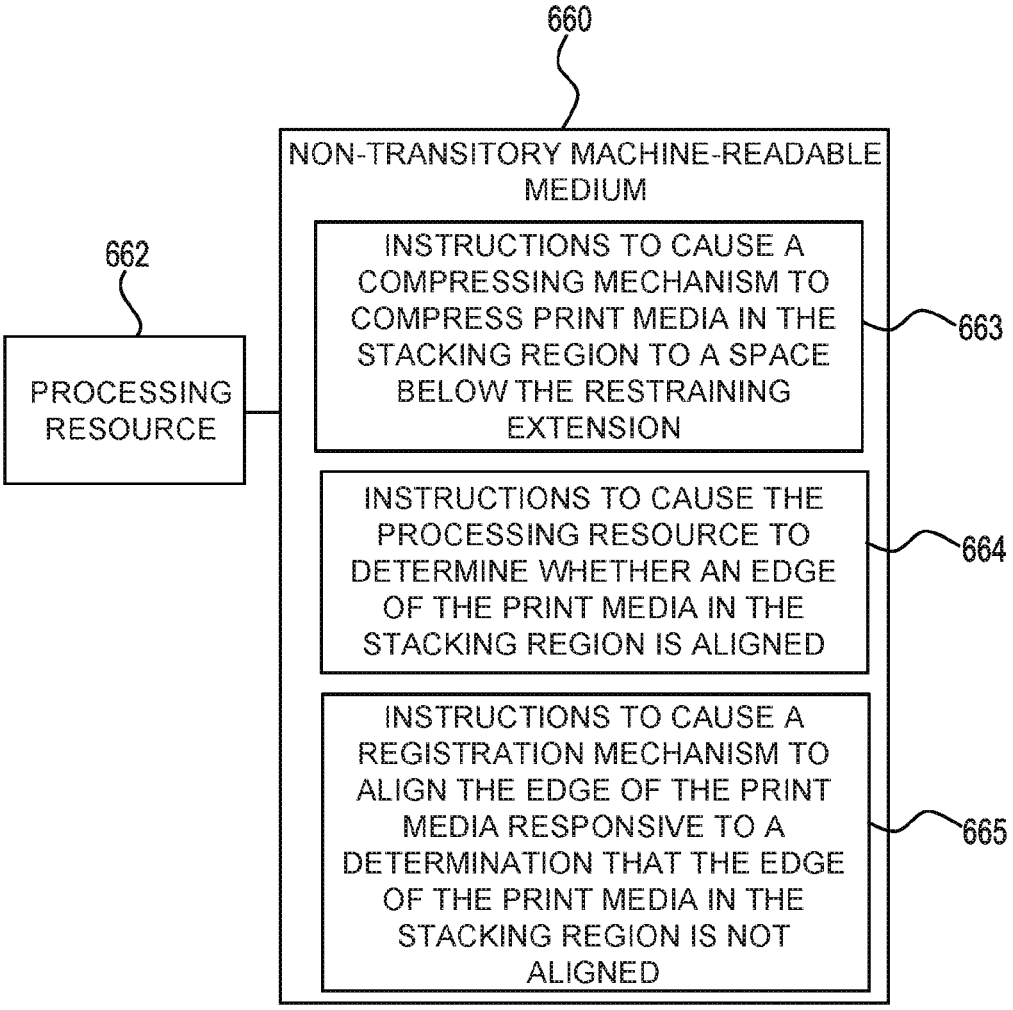
FIG. 6 illustrates an example diagram of a non-transitory machine-readable medium suitable for use with a restraining extension.

FIG. 6 illustrates an example diagram of a non-transitory machine-readable medium 660 suitable for use with a restraining extension. A processing resource 662 may execute instructions stored on the non-transitory machine-readable medium 660. The processing resource 662 may be a hardware processing unit such as a microprocessor, microcontroller, application specific instruction set processor, coprocessor, network processor, or similar hardware circuitry that may cause machine-readable instructions to be executed. In some examples, the processing resource 662 may be a plurality of hardware processing units that may cause machine-readable instructions to be executed. The processing resource 662 may include central processing units (CPUs) among other types of processing units. The non-transitory machine-readable medium 660 may be any type of volatile or non-volatile memory or storage, such as random-access memory (RAM), flash memory, read-only memory (ROM), storage volumes, a hard disk, or a combination thereof.

The medium 660 stores instructions 663 executable by a processing resource 662 to cause a compressing mechanism to compress print media in the stacking region to a space below the restraining extension. In some examples, the compressing mechanism may compress the print media to a space below the restraining extension until the restraining extension is in position to prevent the edge of the print media from reaching above a designated height. That is, the compressing mechanism compresses the print media until the restraining extension is adjacent to the print media, and/or stapling of unaligned print media may yield undesirable results.

The medium 660 stores instructions 664 executable by a processing resource 662 to cause the processing resource to determine whether an edge of the print media in the stacking region is aligned. In some examples, it may be difficult to transport misaligned print media to a finishing region and/or stapling region. That is, it may be difficult to staple the print media in a stapling region if the edge of the print media is not aligned.

The medium 660 stores instructions 665 executable by a processing resource 662 to cause a registration mechanism to align the edge of the print media responsive to a determination that the edge of the print media in the stacking region is not aligned. In some examples, the registration mechanism may facilitate alignment of the incoming print medium with other medium that may be in the stacking region. That is, the registration mechanism may align print media before transport to the finishing region and/or stapling region for post processing.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure and should not be taken in a limiting sense.

It should be understood that the descriptions of various examples may not be drawn to scale and thus, the descriptions may have a different size and/or configuration other than as shown therein.

What is claimed:

1. A system comprising:

a media support including a wall and a base;

a restraining extension extending in a first direction to constrain print media, to a space below the restraining extension; and a media guide to exert a force on the restraining extension to cause the restraining extension to transition from a first position toward a second position.

2. The system of claim 1, wherein the wall of the media support includes a lifting mechanism to transition the restraining extension from the second position toward the first position.

3. The system of claim 1, wherein the restraining extension is coupled to the wall of the media support.

4. The system of claim 1, further comprising a clamping mechanism to transfer print media from the media guide to a stacking region.

5. The system of claim 4, further comprising a compressing mechanism to compress the print media to the stacking region.

6. The system of claim 1, wherein the media support includes an additional wall having an additional restraining extension.

7. The system of claim 1, wherein the media support is to transport the print media into a stapling region.

8. A printing device comprising:

a media support including a wall and a base, wherein the wall is to include a lifting mechanism to cause a restraining extension to transition from a second position toward a first position;

a media guide, adjacent to the media support, to exert a force on the restraining extension to cause the restraining extension to transition from the first position toward the second position;

a clamping mechanism to deliver a print media from the media guide to a stacking region of the media support; and the restraining extension coupled to the wall of the media support and positioned substantially perpendicular to the wall of the media support.

9. The printing device of claim 8, wherein the media guide is to transition towards the restraining extension to exert the force on the restraining extension.

10. The printing device of claim 8, further comprising a non-transitory machine-readable medium storing instructions that when executed by a processing resource to cause a compressing mechanism to compress print media in the stacking region to a space below the restraining extension.

11. The printing device of claim 10, wherein the non-transitory machine-readable medium further comprises instructions that when executed are to cause the processing resource to determine whether an edge of the print media in the stacking region is aligned.

12. The printing device of claim 11, wherein the non-transitory machine-readable medium further comprises instructions that when executed are to cause a registration mechanism to align the edge of the print media responsive to a determination that the edge of the print media in the stacking region is not aligned.

13. The printing device of claim 8, wherein the wall transitions away from the stacking region prior to the delivery of print media to the stacking region.

14. The printing device of claim 8, wherein the wall transitions toward the stacking region after the print media is delivered to the stacking region.

15. A finishing device comprising:

a media guide, adjacent to a media support, to exert a force on a restraining extension to cause the restraining extension to transition from a first position toward a second position;

a clamping mechanism to transfer print media from the media guide to a stacking region; the media support including a base and a plurality of walls; and the restraining extension coupled to a first wall of the plurality of walls and extending in a first direction that is substantially parallel with the base of the media support.

16. The finishing device of claim 15, further comprising an alignment sensor to send a signal to a processing resource responsive to alignment of an edge of the print media.

17. The finishing device of claim 15, wherein the media guide is to transition print media towards the stacking region.

* * * * *